United States Patent [19]

Thayer

[11] Patent Number: 4,905,564

[45] Date of Patent: Mar. 6, 1990

[54] ROTARY SOUND PATH SELECTOR VALVE WITH BIASED ROTOR

[76] Inventor: Orla E. Thayer, P.O. Box 475, Waldport, Oreg. 97394

[21] Appl. No.: 268,843

[22] Filed: Nov. 8, 1988

[51] Int. Cl.[4] ..... G10D 9/04

[52] U.S. Cl. ..... 84/390

[58] Field of Search ..... 84/390–392

[56] References Cited

U.S. PATENT DOCUMENTS

| | | | |
|---|---|---|---|
| 105,059 | 7/1970 | Fietz | 84/392 |
| 455,562 | 7/1891 | Gates | 84/393 |
| 461,131 | 10/1891 | Pietz | 84/390 |
| 1,244,745 | 10/1917 | King | 84/390 |
| 1,428,675 | 9/1922 | Alschausky | 84/395 |
| 1,703,411 | 2/1929 | Steinmetz | 84/390 |
| 2,106,281 | 1/1938 | Sattler | 84/390 |
| 2,259,756 | 10/1941 | Lindsay | 84/388 |
| 2,794,358 | 6/1957 | Meredith | 84/388 |
| 3,175,449 | 3/1965 | Kravka | 84/390 |
| 3,641,863 | 2/1972 | Kanstul et al. | 84/390 |
| 3,780,756 | 12/1973 | Pennington | 137/119 |
| 3,886,837 | 6/1975 | Veneklasen | 84/388 |
| 3,933,078 | 1/1976 | Veneklasen | 84/387 |
| 4,047,459 | 9/1977 | Nakamura | 84/390 |
| 4,112,806 | 9/1978 | Thayer | 84/390 |
| 4,213,371 | 7/1980 | Thayer | 84/390 |
| 4,276,804 | 7/1981 | Holland | 84/394 |
| 4,299,156 | 11/1981 | Thayer | 84/390 |
| 4,469,002 | 9/1984 | Thayer | 84/390 |
| 4,718,318 | 1/1988 | Boy | 84/390 |

*Primary Examiner*—Lawrence R. Franklin

*Attorney, Agent, or Firm*—Klarquist, Sparkman, Campbell, Leigh and Whinston

[57] ABSTRACT

A rotary valve coupled into the principal sound path of a musical wind instrument for selectively inserting and removing one or more acoustic pipe segments from the sound path is disclosed. The valve includes a tapered housing enclosing a tapered lightweight rotor having at least one acoustic passage therethrough. The rotor is comprised of first and second axially coupled portions separated by a biasing spring tending to axially urge the portions apart. Each rotor acoustic passage is coupled inside the rotor to the rotor portions so as to permit the rotor portions to be axially separated from each other a predetermined distance while preserving the airtight seal between the rotor acoustic passage and each rotor portion. Hence, the rotor is axially self-adjusting in the valve housing, maintaining seal integrity of rotor apertures to housing apertures without periodic maintenance or adjustment.

18 Claims, 2 Drawing Sheets

ROTARY SOUND PATH SELECTOR VALVE WITH BIASED ROTOR

BACKGROUND OF THE INVENTION

1. Field of the Invention

This application relates to a rotary fluid flow switch and more specifically to a lightweight rotary sound path selector valve for a musical wind instrument having an acoustic pipe terminating on opposite ends with a mouthpiece and instrument bell, respectively, and having one or more intermediate acoustic pipe segments that can be selectively added into the overall length of the acoustic pipe.

2. General Discussion of the Background

Rotary valves are highly regarded for use in musical wind instruments due to their quick action and relative simplicity of structure as compared to piston type valves.

U.S. Pat. Nos. 4,112,806; 4,213,371; 4,299,156; and 4,469,002 disclose improved rotary sound path selector valves that add few unwanted harmonics to a musical instrument's tone. Valve rotors described therein have at least two acoustic passages extending therethrough which have minimal curvature, no edges in the sound path, and no regions of varying cross-sectional area. The acoustic passages align axially with the instrument's lead pipe, main bore, and slide loop ends so that a minimum of undesired harmonics are added to the tone of the instrument.

Existing instrument valves, however, including those described in the above-cited patents, have a number of potential drawbacks. First, they have rigid rotors and casings that require a certain clearance between the rotor casing and rotor to permit free rotation of the rotor in the casing. Second, to facilitate such rotation and to minimize air leaks at points of connection between passages in the rotor and casing apertures, a lubricant is used, which must be cleaned off the parts and replaced during periodic valve overhauls. Third, rotor clearance must be frequently manually adjusted because it is affected by temperature, moisture, amount of lubricant in the valve, soil content of the lubricant, age of the lubricant in the valve, and other factors. Fourth, existing valves are subject to wear, which reduces the airtightness of connected passages, thereby possibly producing undesirable overtones, and can cause rattling when the valve is operated. Fifth, existing valves are also adversely affected by foreign particles on unyielding rotor and interior casing surfaces which can cause the rotor to seize. Sixth, some existing valves are individually manufactured via complex machining operations which add appreciable cost and limited interchangeability of parts. Finally, existing valves are typically fabricated entirely of metals, which generally require lubrication. All-metal valves are heavy and consequently generally require more effort to operate than one would desire.

Hence, there is a need for a musical instrument acoustic path rotary selector valve that, in addition to having minimally curved acoustic passages, has a low-mass rotor that automatically remains seated on bearing surfaces in the casing, and that dimensionally compensates for wear and environmental changes, thus maintaining seal integrity of rotor apertures to casing apertures without periodic adjustment or maintenance. There is also a need for a musical instrument acoustic path rotary selector valve having a jam-free rotor that is quiet in operation, requires no lubricant, and is manufacturable at low cost.

SUMMARY OF THE INVENTION

The present invention is a musical instrument rotary acoustic path selector valve having minimally curved acoustic passages and uniform circular cross-sectional profile with no abrupt edges in the sound path. In addition, the valve possesses a dynamic biasing means to maintain rotor bearing surfaces in slight tensioned rotatable contact with corresponding bearing surfaces on the inside walls of the valve casing, allowing compensation for wear, resistance to rotor jamming, and self-adjusting maintenance of intimacy of contact of rotor apertures with valve casing apertures. In addition, acoustic passages through the valve are extendably jointed at least one location to ensure self adjustment in the axial direction while maintaining airtightness of connected acoustic passages, and purity of tone. The valve of the present invention requires no lubricant and provides quick operation by the instrumentalist with minimal effort due to the low rotor mass. Finally, the valve rotor of the present invention may be produced by injection molding at low cost, making musically superior performance available to the mass market.

An object of the present invention is to provide a compact rotary acoustic path selector valve that not only has minimally curved acoustic passages having uniform circular cross-sectional profile and no abrupt edges but also a rotor that self-adjusts in length along the axis of rotation, thereby maintaining tensioned intimate contact of rotor apertures with valve casing apertures.

Another object is to provide such a valve having a rotor that automatically compensates for rotor wear and dimensional changes resulting from temperature, moisture, and other environmental parameters.

Another object is to provide such a valve with a self-lubricating rotor.

Another object is to provide such a valve having a rotor that will not bind in the rotor casing as a result of particulate matter incursion into the casing interior.

Another object is to provide such a valve with a self-adjusting rotor that compensates for dimensional differences among similar rotors or casings, thereby facilitating interchangeability of parts.

Another object is to provide such a valve that operates quietly.

Another object is to provide such a valve with a low-mass rotor to ensure quick operation with minimal effort.

Another object is to make such a valve that can be made at low cost.

Other objects, advantages, and features of this invention will become apparent to those skilled in the art upon reading the following specification.

DETAILED DESCRIPTION OF THE PREFERRED EMBODIMENT

Figures 1, 5, 6, 7:
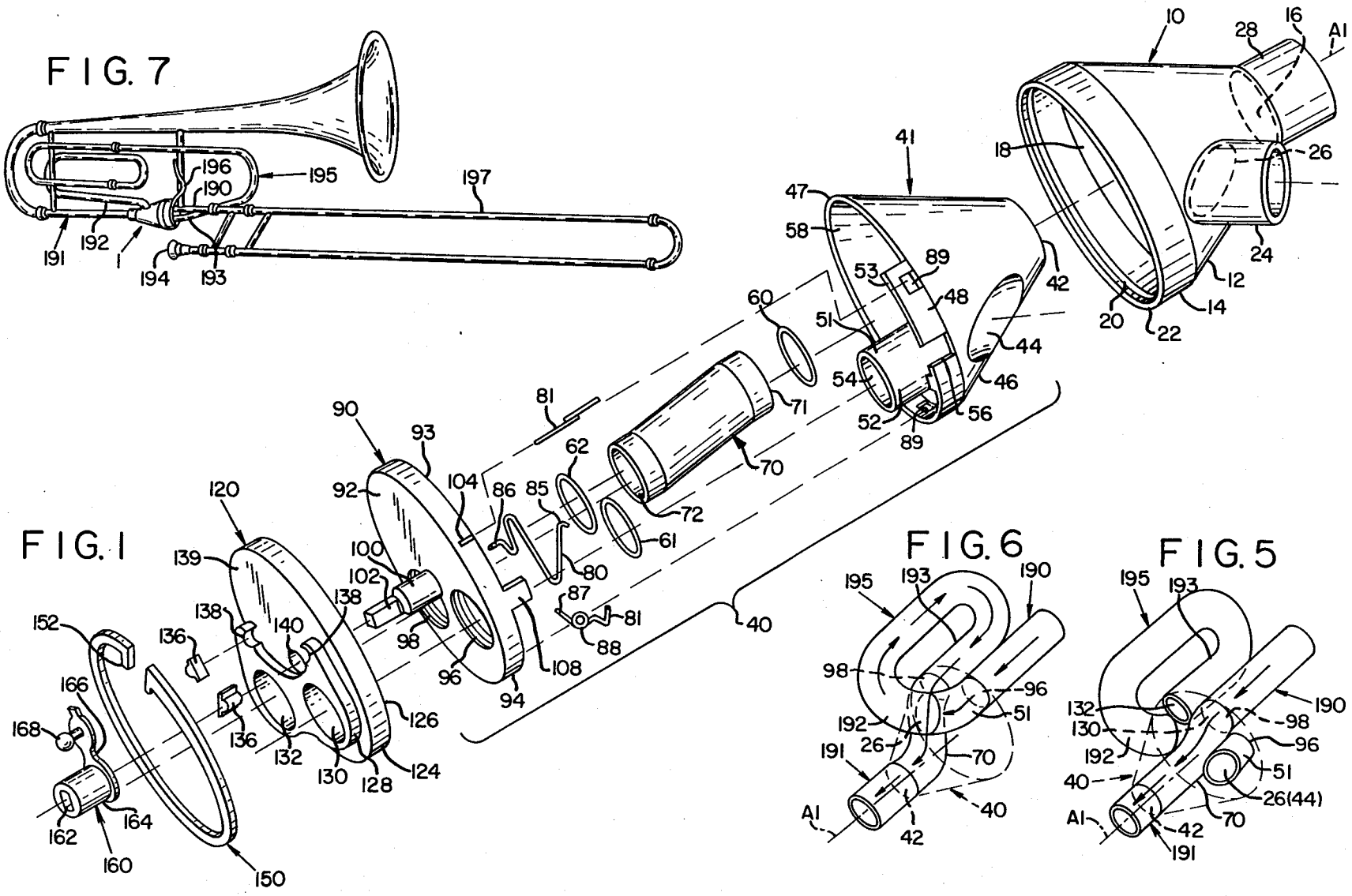
FIG. 1 is an isometric, exploded view of a valve according to the present invention.
FIG. 5 is an isometric schematic view showing the flowpath of a valve according to the present invention with a rotor in a first, or direct-flow, position.
FIG. 6 is an isometric schematic view showing the flowpath of the valve of FIG. 5 with a rotor in a second, or diverted-flow, position.
FIG. 7 is a side elevation showing a trombone incorporating a valve according to the present invention.

With reference to the drawing, FIG. 1 illustrates a valve according to the present invention, which has longitudinal axis A1, a casing 10 and casing end plate 120 transverse to axis A1. The casing 10 and end plate 120 substantially enclose a rotor assembly 40. End plate 120 is secured detachably to the casing 10 with a snap ring 150.

The casing 10 includes a tapered portion 12 having an open base end and an open narrowed end which defines a frustum aperture 16. The base end is joined to a cylindrical portion 14 coaxial with axis A1, which cylindrical portion extends to a circular rim 22 serving as the base end of the casing 10. Casing 10 also includes a cylindrical portion 28 that is joined coaxially to the narrowed end of tapered portion 12 and that surrounds the frustum aperture 16.

The tapered portion 12 also defines a casing wall aperture 26 surrounded externally by a cylindrical sleeve 24 intersecting tapered portion 12 at a minimal angle relative to axis A1.

A groove 20 is cut circumferentially into the inside wall of the cylindrical portion 14 to receive the snap ring 150 when the valve is fully assembled.

The casing end plate 120 is preferably circular, fitting coaxially inside the cylindrical portion 14 of the casing 10 when the valve is fully assembled. The end plate 120 has an internally facing surface 126 transverse to axis A1. The end plate 120 also defines two casing end plate apertures 130 and 132. The primary casing end plate aperture 130 has an axis parallel to but displaced from axis A1. The secondary end plate aperture 132 is displaced an equal distance away from axis A1 but in a different radial direction than primary end plate aperture 130. End plate apertures 130 and 132 extend through a thick portion 128 at end plate 120, which thick portion extends externally in the axial direction from an external surface 139. A shaft aperture 140 extends coaxially through the center of end plate 120. Thick portion 128 also includes two extensions each defining a slot 138. An elastomeric stop bumper 136 fits into each slot 138.

Inside the valve casing are opposing first and second bearing surfaces, coaxial with axis A1, on which the rotor 40 rotates. A first bearing surface 18, having a substantially conical shape, comprises a portion of the interior surface of casing 10. As shown in FIG. 1, the first bearing surface 18 serves as a seat for an exterior tapered surface 46 of a rotor tapered portion 41. The second bearing surface is the substantially planar inner surface 126 of casing end plate 120, which inner surface 126 contacts a substantially planar exterior surface 92 of rotor head 90.

Although the illustrated inner surface 126 of casing end plate 120 is substantially planar, it could also be tapered in shape, the taper extending axially, and still be within the scope of the present invention.

The casing 10 and end plate 120 can be fabricated from any of a number of materials, including brass, aluminum with a noncorrodible plating, or a molded rigid plastic material such as Delrin (polymethylene oxide).

Figure 2B:
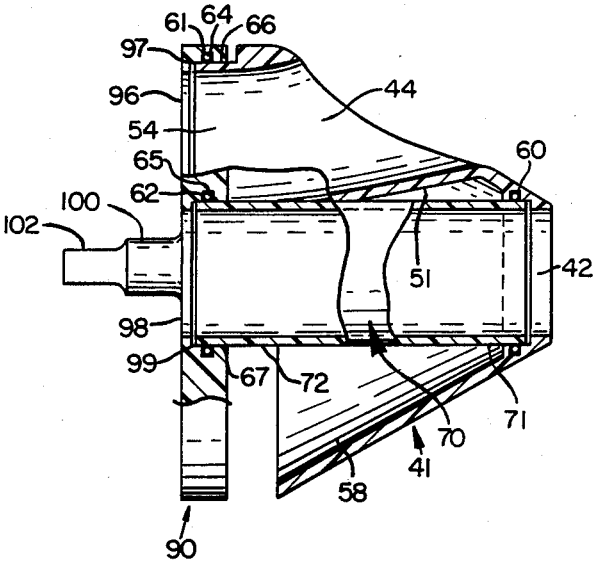
FIGS. 2A and 2B are side sectional views, with portions broken away, of an assembled rotor of the valve.

Referring to FIG. 1 and FIG. 2, the rotor assembly 40 is coaxial with casing 10 and end plate 120 and comprises the rotor tapered portion 41; a transverse rotor head 90, a primary rotor passage 70; a secondary rotor passage 51; O-rings 60, 61, and 62; a compression spring 80; and retaining springs 81. The outside surfaces 41 and 92 of rotor 40 conform substantially to the first bearing surface 18 and interior surface 126, respectively, when the valve is fully assembled.

Figure 4:
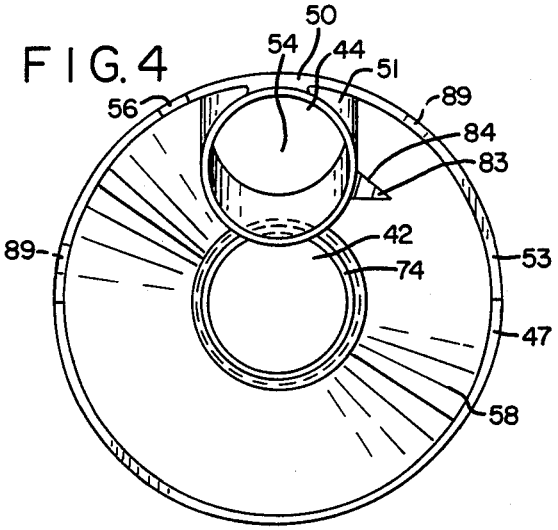
FIG. 4 is an end view of the rotor tapered portion of FIG. 3.
Figure 3:
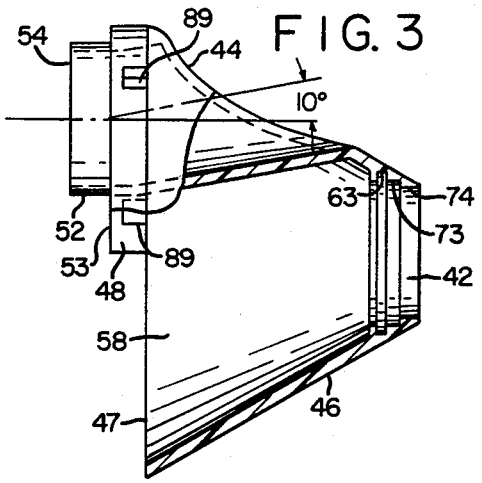
FIG. 3 is a side sectional view of a rotor tapered portion of the valve.

Referring to FIG. 3 and FIG. 4, the rotor tapered portion 41 is substantially conical in shape, defining a frustum aperture 42. The opposite, or base, end of rotor tapered portion 41 is substantially open. The rotor exterior tapered surface 46 is complementary to the first bearing surface 18 of casing 10. Accordingly, in the illustrated embodiment, surface 46 has the same angle of generation as the first bearing surface 18 of casing 10 in FIG. 1 and rotatably contacts the surface 18 when the rotor 40 is assembled into casing 10. Being circular in cross section, the surface 18 maintains rotor frustum aperture 42 in continuous axial alignment with the casing frustum aperture 16 in an assembled valve.

A rotor wall aperture 44 extends through the rotor exterior surface 46 at a location between the rotor ends such that rotor wall aperture 44 is aligned with the casing wall aperture 26 whenever rotor 40 is appropriately rotationally positioned in casing 10.

Referring further to FIG. 3 and FIG. 4, the rotor tapered portion 41 includes the secondary rotor passage 51 and a half-cylindrical portion 48 extending axially from an edge 47. The secondary rotor passage 51 is rigidly attached lengthwise to an inside wall 58 of rotor tapered portion 41 via a radial extension 50 extending toward axis A1 from the mid-arc position of the half-cylindrical portion 48. An end portion 52 of secondary rotor passage 51 extends parallel to axis A1 beyond the transverse plane defined by an edge 53 of half-cylindrical portion 48. The opposite end of secondary rotor passage 51 connects inside rotor cavity 58 to the rotor wall aperture 44.

The rotor tapered portion 41 is preferably fabricated from an injection-moldable rigid polymeric plastic material such as Delrin (polymethylene oxide), which has sufficient rigidity, a lower mass than most metals, and a slippery surface requiring no lubrication in an application such as in the present invention. Although plastic molding is the preferred method for rotor fabrication, other processes such as machining may also be employed. When a molding process is employed, it is best for the half-cylindrical portion 48 to define an arc in the transverse plane of 180° or less so that molded rotor tapered portion 41 can be easily released from the mold during fabrication.

The rotor passages serve as conduits for air and acoustic waves traveling through the rotor 40. As shown in FIG. 1 and FIG. 2, the primary rotor passage 70 extends through the rotor and connects a primary rotor head aperture 98 with the rotor frustum aperture 42. The primary rotor passage 70 is a rigid conduit preferably fabricated from the same material as rotor tapered portion 41. It has a slight S-curved shape with circular transverse section and an open first end 71 and an open second end 72, both of which have axes substantially parallel to axis A1.

Because of the manner in which the various rotor components fit together, as discussed below, the primary rotor passage 70 and rotor head 90 are assembled with rotor tapered portion 41 at the same time. Referring to FIGS. 2, 3 and 4, the first end 71 coaxially aligns with the rotor frustum aperture 42 by slidably fitting into a cylindrical seat 73 where it is stopped by a shoulder 74. The exterior circumference of the first end 71 is detachably sealed to rotor tapered portion 41 by the O-ring 60 held captive in a circular gland 63. The second end 72 coaxially aligns with the primary aperture 98 of rotor head 90, by slidably fitting into a cylindrical seat 67 where it is stopped by a shoulder 99. The exterior circumference of the second end 72 is detachably sealed to the rotor head 90 by the O-ring 62 held captive in a gland 65.

The secondary rotor passage 51 also extends through the rotor and connects the rotor wall aperture 44 with a secondary rotor head aperture 96. The secondary rotor passage 61 is typically slightly curved. In the illustrated embodiment, the axis of rotor wall aperture 44 diverges 10° from the axis of secondary rotor head aperture 96 in a direction radially outward from axis A1. It is desirable to maximize the radius of the curvature so as to minimize the resistance of secondary rotor passage 51 to sound waves passing therethrough.

The end portion 52 of secondary rotor passage 51 coaxially aligns with the secondary rotor head aperture 96 by slidably fitting into a cylindrical seat 66 recessed into an interior transverse surface 93 of rotor head 90, where it is stopped by a shoulder 97. The exterior circumference of end portion 52 is detachably sealed to the rotor head by the O-ring 61 held captive in a gland 64. Apertures in the rotor and corresponding apertures in the casing preferably have the same shape and size to minimize resistance to sound waves passing between casing and rotor and to minimize generation of overtones.

Figure 2A:
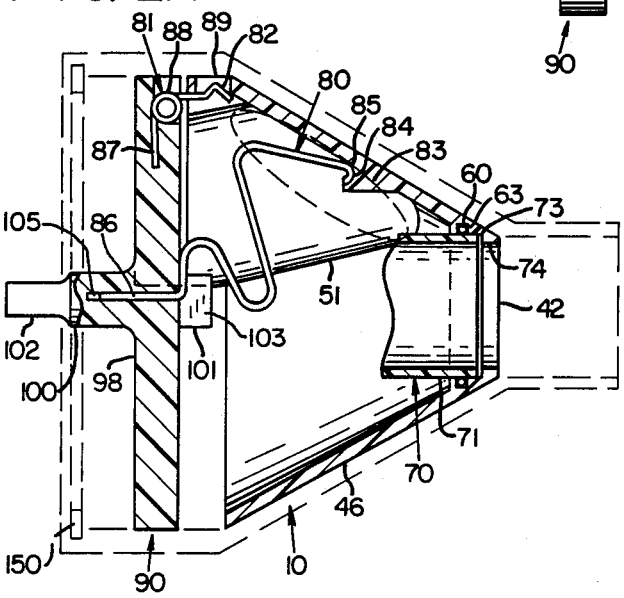

The rotor tapered portion 41 is detachably latched to the rotor head 90 by the two identical retaining springs 81. Referring to FIG. 1, each retaining spring is mounted to the rotor head via a tail 87 and a loop 88 fitted into a radial slot 104. The purpose of the retaining springs 81 is to hold the rotor assembly 40 together whenever the assembly is removed from the casing 10. Referring now to FIG. 2A, in a fully assembled valve, the rotor tapered portion 41 and rotor head 90 are pressed slightly closer together than when the rotor 40 is removed from the valve casing so that the crooks 82 in said retaining springs are not actually touching the respective adjacent edges of the latch openings 89. In other words, the retaining springs 81 serve no function whenever the rotor 40 is assembled in the casing; they only hold the rotor 40 together when it is removed from the casing.

The rotor head 90, when spring-latched to rotor tapered portion 41, as described above, is also under a light spring biasing force which axially pushes the two components apart, as effected by the compression spring 80. As shown in FIG. 2A, a tail 86 of said compression spring 80 is inserted into a hole 105 in the center of a shaft hub 101. A slot 103 cut diagonally across the hub 101 and intersecting hole 105 keeps the spring 80 oriented at the proper angle. The spring 80 is bent in an S-curve to reduce the spring force and terminates in a crook 85 which pressably engages a depression 84 in a ledge 83 which is situated as a projection on the interior wall 58 of rotor tapered portion 41 adjacent to the secondary rotor passage 51. The spring 80 has sufficient spring force to lightly push the rotor head 90 away from the rotor tapered portion 41, but not enough to overcome the grip of retaining springs 81 in their respective latch openings when the rotor assembly 40 is removed from the casing.

In a fully assembled valve, compression spring 80 simultaneously maintains both the exterior surface 92 of the rotor head 90 in light contact with the inside surface 126 of casing end plate 120 and the exterior tapered surface 46 of rotor tapered portion 41 in light contact with the inside surface 18 of casing 10. The contacting surfaces function as opposed rotational bearing surfaces for rotor assembly 40 relative to the casing. The force of compression spring 80 is very slight; the spring does not impart significant rotational drag to the rotor in the casing. As a result, the rotor assembly rotatably "floats" in the valve casing. Because the internal apertures open onto rotor bearing surfaces, such a floating rotor also prevents significant leakage of sonic energy and air pressure between acoustic passages or to the atmosphere, and keeps the rotor frustum aperture 42 in axial alignment with the casing frustum aperture 16 at all times. As the rotor axially expands or contracts, the rotor passages 51 and 70 also slide axially in their respective seats while still remaining circumferentially sealed therein by their respective O-rings.

When the rotor 40 is assembled, a key tab 108 on rotor head 90 nests in a keyway 56 on rotor tapered portion 41. The nested key tab enables the rotor head 90, when rotated about axis A1 via a torque applied to a rotor shaft 100, to also rotate the rotor tapered portion 41 without slippage.

In a fully assembled valve, the rotor shaft 100 passes, coaxially to axis A1, through the shaft aperture 140 on casing end plate 120. Rotor shaft 100 has one or more flatted surfaces 102 to ensure a nonslip fit with a rotor rotating mechanism 160.

Referring to FIG. 1, the rotor rotating mechanism 160 is comprised of a cylindrical portion 164 with an axial passage 162, a crank 166, and a ball 168. The cylindrical portion 164 attaches to the rotor shaft 100 by inserting the end of the latter into the passage 162 with the crank 166 positioned between cushioned stops formed by bumpers 136 inserted into slots 138 on the casing end plate 120. The ball 168 forms a ball joint with a mechanical linkage (not shown) which connects with a finger-actuated key or lever pivotably mounted in a convenient location on the instrument.

Valves according to the present invention are preferably substantially conical in shape. A conical valve is advantageous because, at a given instrument tube size, such a valve occupies less space and weighs less than other valves having comparably straight acoustic passages. However, axially tapered configurations other than as described are within the scope of the present invention. Such configurations include various unilaterally or bilaterally tapered designs, or any other analogous geometric configuration that would tend to keep the rotor centered on its axis when enclosed in the valve casing.

Substantially conical valves are also well suited for use in compact instruments and instruments requiring short slide loops. For example, the distance between the primary rotor head aperture 98 and the rotor wall aperture 44 is so short that even the shortest slide loop can be positioned with its ends in registry with those apertures.

Instrument tubes are mounted to the casing so that they connect with the casing apertures. For optimal tone quality, the tubes and apertures are preferably in axial alignment so that a minimum amount of resistance is encountered during the transfer of sound waves from the instrument tube through a first casing aperture, through the rotor passage, through a second casing aperture, then to the downstream instrument pipe.

To illustrate connection of a valve according to the present invention to a musical instrument, FIG. 7 shows such a valve assembly 1 connected to acoustic tubes of a trombone. A lead pipe 190 and a main bore 91 connect to opposite ends of the casing. The lead pipe 190 extends from a mouthpiece 194 and a slide 197 and is connected to the primary casing end plate aperture 130. The main bore 191 of the instrument connects to the casing frustum aperture 16 via the sleeve 28. A "slide loop" or acoustic passage of defined length 195 has opposite ends 192 and 193 which connect to the casing wall aperture 26 via the sleeve 24 and to the secondary casing end plate aperture 132, respectively. In order to connect the slide loop 195 between the lead pipe 190 and main bore 191, the instrumentalist must appropriately rotate the valve rotor in the casing from its resting position where the rotor head aperture 98 registers with the primary casing aperture 130 to the position where the rotor head aperture 98 registers with the secondary casing aperture 132. By thereby connecting slide loop 195, the fundamental pitch of the trombone is lowered, depending upon the length of slide loop 195. The longer the length, the lower the pitch.

A mechanism is provided on the instrument for rotating the valve shaft and rotor. Referring further to FIG. 7, such a rotating mechanism can be of a common variety that employs a finger-actuated lever 196 pivotably mounted to the instrument and mechanically linked to the ball 168 on the crank 166 attached to the rotor shaft 100. The lever 196 is thereby linked in such a manner that movement of the lever 196 causes rotation of the shaft 100. Typically, when the instrumentalist moves lever 196, the associated mechanical linkage causes ball 168 to orbit in a minor arc around axis A1 in a plane transverse to axis A1, thereby applying a torque to the shaft 100 and rotating the rotor assembly 40. In a first rotor position as shown in FIG. 5, in which the slide loop 195 is not connected between the instrument's lead pipe 190 and main bore 191, the primary rotor passage 70 connects the lead pipe 190 directly to the main bore 191. When the instrumentalist depresses lever 196, rotor assembly 40 is rotated about axis A1 to the second, or diverted-flow, position, as shown in FIG. 6, in which the secondary rotor passage 51 connects the lead pipe 190 with one end 192 of the slide loop; and the primary rotor passage 70 connects the other end 193 of the slide loop with main bore 191. Thus, when the rotor is in the first position as shown in FIG. 5, sound waves can travel directly between the lead pip 190 and main bore 191. When the rotor is in the diverted-flow position as shown in FIG. 6, sound waves must pass through the slide loop 195 when traveling between the lead pipe 190 and main bore 191.

The elastomeric bumpers 136 inserted into slots on the raised portion 128 of casing end plate 120, as shown in FIG. 1, provide stops for limiting rotational movement of the crank 166, thereby assuring positive alignment between rotor apertures and casing apertures when the rotor is either in the first position or in the diverted-flow position.

Rotor assembly 40 may be removed for inspection and cleaning by first removing the snap ring 150 from the casing 10 and disconnecting the crank 166 from the shaft 100. Second, the end plate 120 is pulled axially away from casing 10, exposing the rotor assembly 40 which can be pulled axially out of casing 10 by manually grasping the shaft 100. To reinstall the rotor, the above procedure is reversed.

While I have shown and described a preferred embodiment of my invention, it will be apparent to those skilled in the art that changes and modifications may be made without departing from my invention in its broader aspects.

As a first example, the biasing means could be present in the casing instead of the rotor. In one such embodiment, the rotor may be fabricated as a single component and the casing end plate comprised of outer and inner axially separable coaxial plates. The outer plate would be stationary and detachably affixed to the casing 10 as in the preferred embodiment. The inner plate would be spring-loaded relative to the outer plate, applying an axial force to the rotor in the casing. Apertures in the inner and outer plate would be connected together by short acoustic passages having axes parallel to axis A1 and having detachably sealed connections therebetween as in the preferred embodiment that can accommodate limited axial expansions or contractions of the space between the inner and outer plates.

As a second example, the rotor tapered portion 41 may be fabricated as a single, solid component defining rotor passages therethrough and including contiguous short tube extensions extending parallel to axis A1 from the base surface similar to extension 52 of the secondary rotor passage 51 in the preferred embodiment. The rotor head would be spring loaded to the rotor tapered portion 41, with the short tube extentions on tapered portion 41 having detachably sealed connections to seats in the rotor head, as in the illustrated embodiment.

As a third example, efficient operation of valves according to the present invention is unaffected by reversing the structure so that the lead pipe of a musical instrument is connected to the frustum aperture 16 and the main bore is connected to primary casing end plate aperture 130. Such reversed valves will operate in substantially the same fashion as the valve hereinbefore illustrated, except that the propagation of sound waves through the valve will be reversed.

As a fourth example, a valve according to the present invention must have at least one rotor passage, at least one primary aperture, and at least one secondary aperture. Once those criteria are satisfied, the principle of the present invention may be applied to rotary acoustic path selector valves having any number of rotor passages and casing apertures selectably connectable to each other thereby, as instrument requirements indicate.

I claim:

1. A rotary acoustic path selector valve for a musical wind instrument having an acoustic pipe terminating at one end with a mouthpiece and at the other end with an instrument bell, and at least one separate acoustic pipe segment selectively connectable via the valve to the length of the acoustic pipe between the mouthpiece and instrument bell, the valve comprising:

casing means having opposing bearing surfaces on the interior surface thereof, the casing having a wall defining a plurality of apertures extending from the exterior to the interior of the casing;

a rotor within the casing, the rotor having opposing bearing surfaces that are complementary to the bearing surfaces of the casing, the rotor being rotatable on the bearing surfaces about a fixed axis, and the rotor having at least one acoustic passage positioned such that an end of such passage is connectable to selected casing apertures by rotating the rotor on its axis to the appropriate radial orientation; and dynamic biasing means for urging intimate rotational contact between the bearing surfaces on the rotor and the complementary bearing surfaces of the casing, thereby maintaining airtight registry between casing apertures and the ends of the rotor passage.

2. The valve of claim 1 wherein each bearing surface on the rotor has a circular profile transverse to and coaxial with the axis of rotor rotation when the rotor is rotated.

3. The valve of claim 1 wherein at least one bearing surface on the rotor has a taper which narrows distally and is coaxial with the axis of rotor rotation.

4. The valve of claim 1 wherein the ends of each acoustic passage through the rotor are located in a bearing surface on the rotor.

5. The valve of claim 1 wherein each casing aperture is located in a bearing surface on the inside of the casing.

6. The valve of claim 1 wherein each rotor acoustic passage is defined by tube means.

7. The valve of claim 1 wherein the rotor is comprised of first and second axially separable coaxial rotor portions, each portion having at least one rotor bearing surface, and both portions linked together such that one portion cannot rotate on its axis independently of the other.

8. The valve of claim 7 wherein the biasing means is comprised of a spring mounted between the first and second rotor portions.

9. The valve of claim 8 wherein the biasing means pushes apart the first and second rotor portions in a substantially axial direction.

10. The valve of claim 9 wherein a latching means between the first and second rotor portions limits the axial distance apart which the biasing means can push the first and second rotor portions of a rotor that has been removed from the casing, the distance being greater than as allowed by the casing when the rotor is installed therein.

11. The valve of claim 10 wherein the latching means holds the rotor together whenever the rotor is removed or being removed from the casing.

12. The valve of claim 7 wherein the biasing means pushes apart the first and second rotor portions with sufficient force to ensure continuous, coaxial, rotational contact of bearing surfaces on the rotor with corresponding complementary bearing surfaces on the inside of the casing, but not with enough force to impart significant rotational drag to the rotor in the casing.

13. The valve of claim 7 wherein each rotor passage tube connects at least one rotor aperture located on the first rotor portion with at least one rotor aperture located on the second rotor portion.

14. The valve of claim 7 wherein:

each rotor acoustic passage is defined by a tube; and each end of each tube is joined to its corresponding rotor portion via a substantially airtight connection, the connection being in axial registry with the corresponding rotor aperture.

15. The valve of claim 14 wherein at least one end of each tube is joined to its corresponding rotor portion via a tube sealing means that allows the rotor to be axially elongated or shortened via the biasing means over a predetermined range of length without significantly breaking the seal.

16. A rotor for a rotary acoustic path selector valve for a musical wind instrument having an acoustic pipe terminating at one end with a mouthpiece and at the other end with an instrument bell, the instrument having at least one separate acoustic pipe segment selectively connectable via the valve to the length of the acoustic pipe between the mouthpiece and instrument bell, and rotor housing means both defining a plurality of housing apertures coupled to acoustic pipe ends and having opposing bearing surfaces on interior walls, the rotor having:

rotational bearing surfaces complementary to the bearing surfaces inside the rotor housing means, multiple rotor apertures being defined by such bearing surfaces;

at least a first and second rotor portion movable relative to each other in a direction along or parallel to the axis of rotor rotation but not rotationally movable relative to each other, the first rotor portion including at least one complementary bearing surface and the second rotor portion including at least one opposing complementary bearing surface;

at least one acoustic conduit through the rotor, each such conduit having a first end coupled to the first rotor portion in registry with a rotor aperture defined by the first rotor portion, and a second end coupled to the second rotor portion in registry with a rotor aperture defined by the second rotor portion, each such conduit having at least one coupling which permits the rotor to be axially lengthened or shortened over a predetermined length range without significantly breaking the airtightness of the coupling; and biasing means between the rotor portions for maintaining the bearing surfaces of the rotor in contact with the corresponding bearing surfaces of the rotor housing means, when installed therein, to maintain airtight registry between housing apertures and rotor apertures selectively connected thereto by rotating the rotor.

17. A rotary acoustic path selector valve for a musical wind instrument having an acoustic pipe terminating at one end with a mouthpiece and at the other end with an instrument bell, and at least two separate acoustic pipe segments selectively connectable via the valve to the length of the acoustic pipe between the mouthpiece and instrument bell, the valve comprising:

a housing means including a housing tapered portion having a frustum end defining a frustum aperture and a base end, and also having a transverse cover portion removably attached to the base end;

the tapered portion having an interior tapered surface defining a first bearing surface, and the cover portion having a surface defining a second bearing surface, the first and second bearing surfaces in axially opposing relationship when the cover portion is attached to the base end, and each bearing surface defining an at least partially circular profile transverse to and coaxial with the housing tapered portion;

the housing means tapered portion defining further a second aperture intersecting the first bearing surface, and the cover portion defining primary and secondary cover-portion apertures spaced an equal distance from the axis of the cover portion and intersecting the second bearing surface;

a rotor substantially enclosed in and coaxial with the housing means and rotatable about the axis of the housing tapered portion, the rotor comprised of first and second axially separable coaxial portions, including a rotor tapered portion and a rotor head portion, each portion having a rotor bearing surface on the exterior surface thereof, and each rotor bearing surface being complementary to the corresponding bearing surface inside the housing means;

the rotor having a dynamic biasing means comprised of a spring positioned between the first and second rotor coaxial portions so as to push apart the first and second rotor coaxial portions in a substantially axial direction with sufficient force to ensure continuous contact of rotor bearing surfaces with corresponding complementary bearing surfaces inside the housing means, but not with enough force to impart significant rotational drag to the rotor in the housing means;

the rotor exterior surface defining four rotor apertures including first and second apertures located at the frustum and in the tapered surface, respectively, and third and fourth apertures located in the rotor head portion, each aperture defined by a bearing surface on the rotor and each registrable with a corresponding housing aperture by rotating the rotor on its axis to an appropriate radial orientation;

the rotor having primary and secondary acoustic passages, each comprised of a tube extending through the space defined by the first and second rotor coaxial portions, each connecting a corresponding rotor aperture on the first rotor coaxial portion with a corresponding rotor aperture on the second rotor coaxial portion, the connections being substantially parallel to the rotor axis and airtight, at least one end of each passage being connected to an aperture on the first or second rotor coaxial portion via a cylindrical sleeve containing a captive O-ring that circumferentially seals the outside diameter of the passage end to the sleeve in a manner that allows the connection to slip in the axial direction within a predetermined range of length without losing airtightness of the seal, thereby allowing the rotor to axially expand and contract in the casing to provide airtight registry of rotor apertures and corresponding housing apertures.

18. A rotor for a rotary acoustic path selector valve for a musical wind instrument having an acoustic pipe terminating at one end with a mouthpiece and at the other end with an instrument bell, the instrument having at least one separate acoustic pipe segment selectively connectable via the valve to the length of the acoustic pipe between the mouthpiece and instrument bell, and rotor housing means both defining a plurality of housing apertures coupled to acoustic pipe ends and having opposing bearing surfaces on interior walls, the rotor having:

rotational bearing surfaces complementary to the bearing surfaces inside the rotor housing means, multiple rotor apertures being defined by such bearing surfaces;

at least a first and second rotor portion movable relative to each other in a direction along or parallel to the axis of rotor rotation but not rotationally movable relative to each other, the first rotor portion including at least one complementary bearing surface and the second rotor portion including at least one opposing complementary bearing surface; and at least one acoustic conduit through the rotor, each such conduit having a first end coupled to the first rotor portion in registry with a rotor aperture defined by the first rotor portion, and a second end coupled to the second rotor portion in registry with a rotor aperture defined by the second rotor portion, each such conduit having at least one coupling which permits the two portions of the rotor to be axially moved relative to each other without significantly breaking the airtightness of the coupling.

* * * * *